US011981478B2

(12) United States Patent
Shimamoto

(10) Patent No.: US 11,981,478 B2
(45) Date of Patent: May 14, 2024

(54) CONTAINER

(71) Applicant: Keiji Shimamoto, Tokyo (JP)

(72) Inventor: Keiji Shimamoto, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 269 days.

(21) Appl. No.: 16/321,403

(22) PCT Filed: Jul. 29, 2016

(86) PCT No.: PCT/JP2016/003525
§ 371 (c)(1),
(2) Date: Jan. 28, 2019

(87) PCT Pub. No.: WO2018/020532
PCT Pub. Date: Feb. 1, 2018

(65) Prior Publication Data
US 2020/0031532 A1 Jan. 30, 2020

(51) Int. Cl.
*B65D 41/34* (2006.01)

(52) U.S. Cl.
CPC ..... *B65D 41/3447* (2013.01)

(58) Field of Classification Search
CPC ..... B65D 41/3442; B65D 41/3447; B65D 41/3428
USPC ..... 280/288; 215/329, 252; 220/288
See application file for complete search history.

(56) References Cited

U.S. PATENT DOCUMENTS

| | | | | |
|---|---|---|---|---|
| 4,432,461 | A | 2/1984 | Mumford et al. | |
| 4,744,479 | A | 5/1988 | Schottli | |
| 4,938,370 | A * | 7/1990 | McBride | B65D 41/3428 215/252 |
| 2007/0095782 | A1* | 5/2007 | Granger | B65D 41/045 215/351 |
| 2016/0311570 | A1* | 10/2016 | Didier | B65D 1/0223 |

FOREIGN PATENT DOCUMENTS

| | | | | |
|---|---|---|---|---|
| EP | 0645318 | A1 * | 3/1995 | B65D 41/3447 |
| EP | 0 703 155 | B1 | 7/1999 | |
| FR | 2900143 | A1 * | 10/2007 | B67B 3/14 |
| JP | 2000-503944 | A | 4/2000 | |
| JP | 2007-176553 | A | 7/2007 | |
| JP | 2008-007130 | A | 1/2008 | |
| JP | 2008-184219 | A | 8/2008 | |
| JP | 2016-060503 | A | 4/2016 | |

OTHER PUBLICATIONS

Dec. 23, 2019 Office Action issued in Canadian Patent Application No. 3,031,871.

(Continued)

*Primary Examiner* — Anthony D Stashick
*Assistant Examiner* — L Kmet
(74) *Attorney, Agent, or Firm* — Oliff PLC

(57) ABSTRACT

In a container, a first distance from an engagement upper end of a male thread of a mouth to a bead portion is larger than a second distance from an engagement lower end of a female thread of a cap to a resiliently deformable portion of a tamper evident band.

15 Claims, 8 Drawing Sheets

(56) References Cited

OTHER PUBLICATIONS

Jan. 29, 2019 International Preliminary Report on Patentability issued in International Patent Application No. PCT/JP2016/003525.
Aug. 25, 2020 Office Action issued in Canadian Patent Application No. 3,031,871.
Oct. 18, 2016 International Search Report issued in International Patent Application No. PCT/JP2016/003525.
Apr. 21, 2020 Office Action issued in Japanese Patent Application No. 2018-530200.

* cited by examiner

CONTAINER

TECHNICAL FIELD

The present disclosure relates to a container.

BACKGROUND

Conventionally, containers including a container body having a tubular mouth and a cap attached to the mouth are known in which containers a tamper evident band for indicating whether the container has been opened (hereinafter also referred to as a TE band) is provided on the cap (for example, see JP 2008-007130 A (PTL 1)).

Such a TE band has a resiliently deformable portion such as a flap. When capping is performed by applying a predetermined press force (top load) to the cap for example using a capping head of a capper in a production step of the container, the resiliently deformable portion is resiliently deformed by being pressed against a bead portion provided on the mouth, thus the resiliently deformable portion rides over the bead portion.

CITATION LIST

Patent Literature

PTL 1: JP 2008-007130 A

SUMMARY

Technical Problem

However, the cap of such a conventional container would be inclined when the resiliently deformable portion of the TE band is pressed against the bead portion of the mouth, and the cap would be screwed on at an angle. Such a skewed attached cap is likely to be caused particularly in the case of a wide mouth container having a mouth with a diameter of 30 mm or more.

In view of the above circumstances, it could be helpful to provide a container which can prevent skewing of an attached cap provided with a tamper evident band.

Solution to Problem

A container of this disclosure includes a container body having a tubular mouth, and a cap attached to the mouth.

The mouth has a male thread and a ring-shaped bead portion provided around a lower portion of the male thread, the cap has a ring-shaped skirt wall on which a female thread threadedly engaged with the male thread is formed, and a ring-shaped tamper evident band provided on a lower end portion of the skirt wall, the tamper evident band has a resiliently deformable portion which is resiliently deformed by being pressed from above against the bead portion to ride over the bead portion downward, and a first distance from an engagement upper end of the male thread of the mouth to the bead portion is larger than a second distance from an engagement lower end of the female thread of the cap to the resiliently deformable portion of the tamper evident band.

An inclination angle of an upper surface of the bead portion is preferably 30° or more.

For the disclosed container, the first distance and the second distance are preferably set so that the resiliently deformable portion of the tamper evident band abuts the bead portion when the female thread is engaged with the male thread over 5 mm or more.

Advantageous Effect

The present disclosure can provide a container which can prevent skewing of an attached cap provided with a tamper evident band.

BRIEF DESCRIPTION OF THE DRAWINGS

In the accompanying drawings:

FIGS. 1A and 1B are diagrams illustrating a container body of a container according to one embodiment of the present disclosure, in which FIG. 1A is a plan view of a mouth and FIG. 1B is a side view of the mouth;

FIGS. 2A and 2B are diagrams illustrating a cap attached to the mouth of the container body depicted in FIGS. 1A and 1B, in which FIG. 2A is a plan view of the cap and FIG. 2B is a side vie of the cap;

DETAILED DESCRIPTION

A container according to one embodiment of the present disclosure will now be described in detail with reference to the drawings. Note that in this specification, vertical directions of the mouth refer to the directions along the central axis of the male thread of the mouth (i.e., upward and downward in FIG. 4), and the upper side is the side of an opening of the mouth and the lower side is the trunk side. Further, the term "vertical directions of the cap" refers to the directions along the central axis of the female thread of the cap (i.e., upward and downward in FIG. 4), and the upper side is the top wall side and the lower side is the tamper evident band side.

Figure 1A:
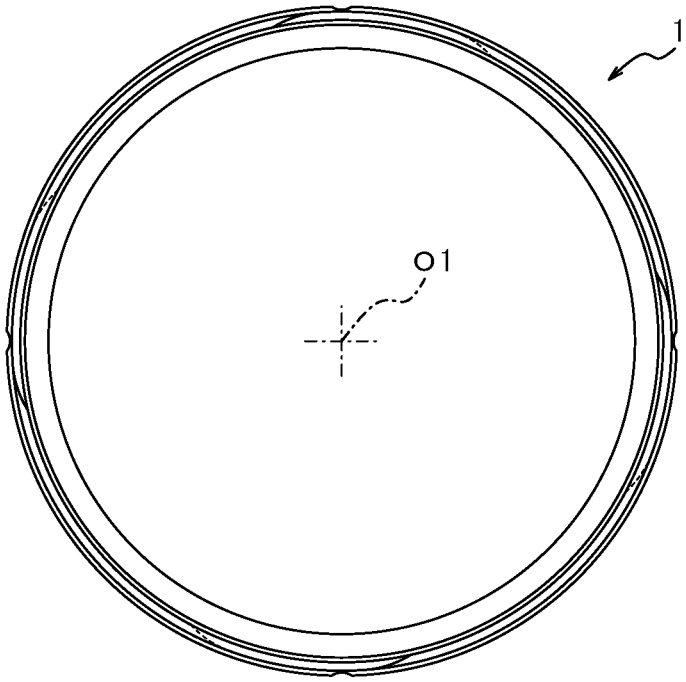
Figure 1B:
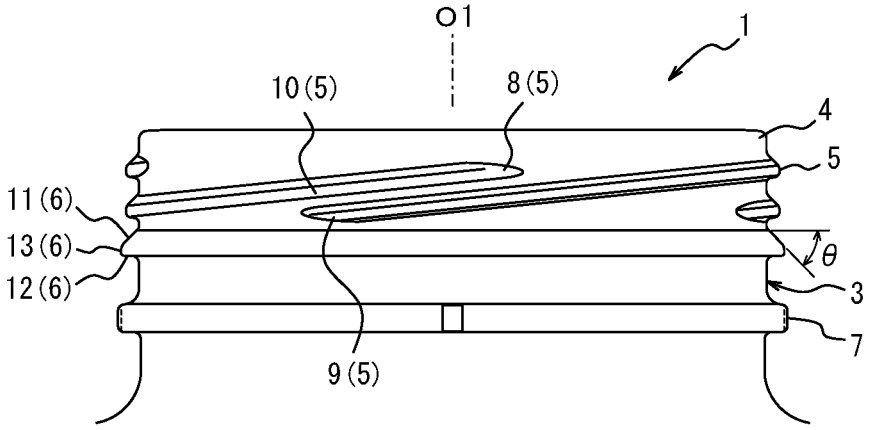
Figure 2A:
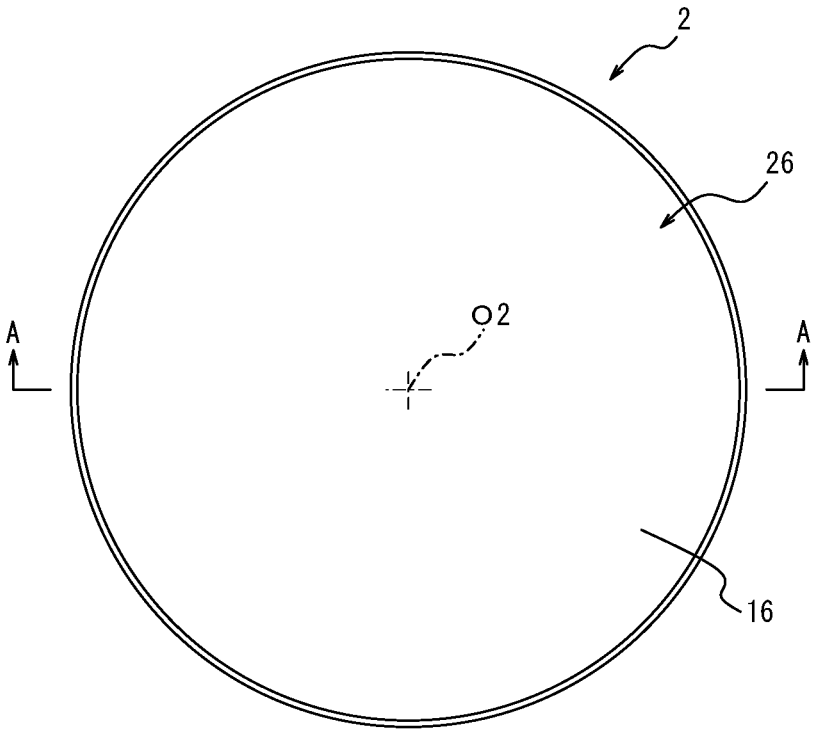
Figure 2B:
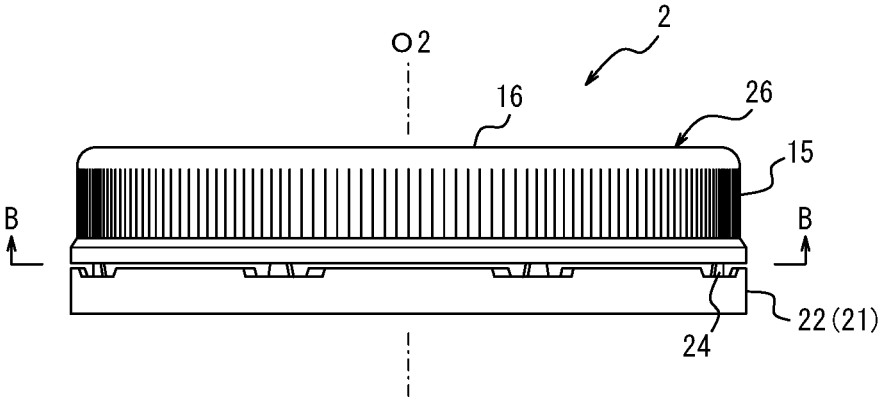
Figure 3A:
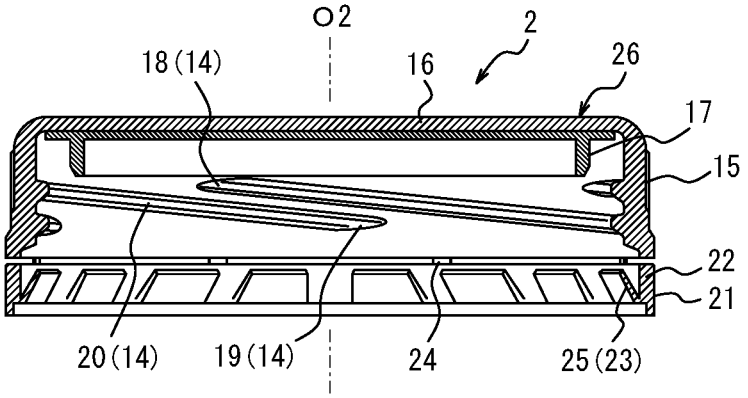
FIG. 3A is a cross-sectional view of FIG. 2A taken along line A-A and FIG. 3B is a cross-sectional view of FIG. 2B taken along line B-B.
Figure 3B:
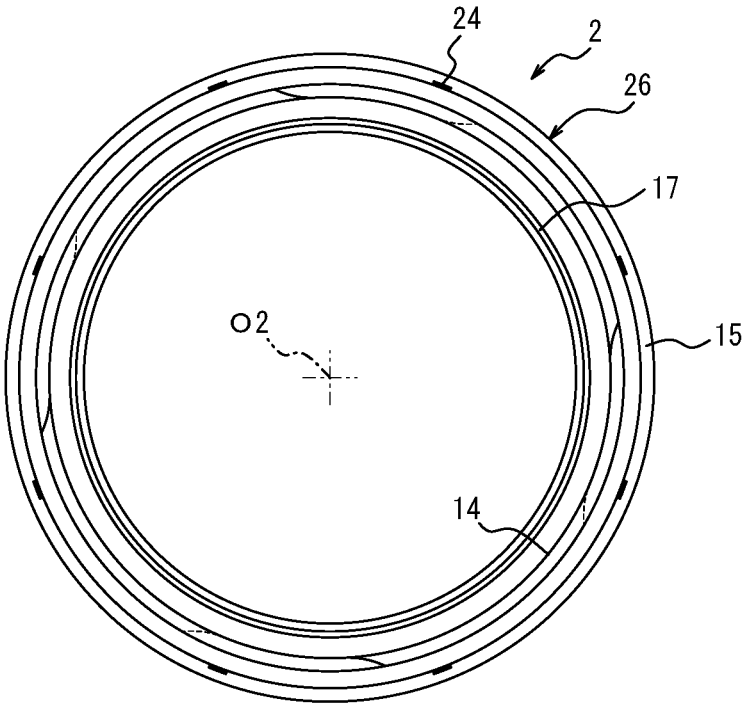

The container of this embodiment includes a container body 1 as illustrated in FIGS. 1A and 1B and a cap 2 as illustrated in FIG. 2A to FIG. 3B.

The container body 1 can be formed, for example, by blow molding using a thermoplastic resin such as polypropylene (PP) or polyethylene terephthalate (PET) as a material. The container body 1 includes a cylindrical mouth 3 connected to a containment space containing a content, a trunk which is connected to the mouth 3 and has a larger diameter than the mouth 3, and a bottom that stops the lower end of the trunk.

The mouth 3 includes a cylindrical mouth circumferential wall 4, a male thread 5 formed along an outer circumferential surface of the mouth circumferential wall 4, a ring-shaped bead portion 6 provided around a lower part of the male thread 5 on the outer circumferential surface of the mouth circumferential wall 4, a ring-shaped neck ring 7 provided around a lower part of the bead portion 6 on the outer circumferential surface of the mouth circumferential wall 4.

In this embodiment, the male thread 5 is constituted by a multiple thread with two or more starts (a quadruple thread in the illustrated example). Alternatively, the male thread 5 may be constituted by a single thread. Further, in the illustrated example, each thread of the male thread 5 includes a thread upper end portion 8 which is located at an upper end of the thread and has a height (radial dimension) and a width (vertical dimension) gradually reduced toward the upper end; a thread lower end portion 9 which is located at a lower end of the thread and has a height and width gradually reduced toward the lower end; and a thread body 10 placed between the thread upper end portion 8 and the thread lower end portion 9.

In the illustrated example, the thread body 10 has a longitudinal sectional shape (a shape cut along a plane including the central axis O1) which is consistent in the circumferential direction. However, each thread body 10 may have a longitudinal sectional shape that varies in the circumferential direction. Each thread body 10 is provided continuously in the circumferential direction in the illustrated example; alternatively, the thread bodies 10 may be provided intermittently in the circumferential direction.

Note that each thread may be constituted only by the thread body 10 without being provided with the thread upper end portion 8 or the thread lower end portion 9. Alternatively, each thread may be constituted by the thread body 10 and one of the thread upper end portion 8 and the thread lower end portion 9.

The bead portion 6 protrudes in a radial direction from the outer circumferential surface of the mouth circumferential wall 4 and is shaped like a ring centered around the central axis O1. The bead portion 6 is provided to be continuous in the circumferential direction in the illustrated example; alternatively, the bead portion 6 may be provided intermittently in the circumferential direction. Further, the bead portion 6 has a conical upper surface 11 at an inclination angle θ (46° in the illustrated example) with respect to a horizontal surface, a lower surface 12 parallel to a horizontal surface, and a side surface 13 connecting the upper surface 11 and the lower surface 12. Note that the shape of the upper surface 11 of the bead portion 6 can be changed as appropriate. For example, the longitudinal sectional shape of the upper surface 11 (the shape in a cross section cut along the plane including the central axis O1) may be a curved shape or may be a combination of a straight line and a curved line without limitation to the straight line shape.

In this embodiment, the container body 1 is formed as a wide mouth container in which the diameter of the outer circumferential surface of the mouth circumferential wall 4 is 30 mm or more (60 mm in the illustrated example). The container body 1 is used to contain a beverage or food; alternatively, the container body 1 may be adapted to contain a variety of contents such as a pharmaceutical product.

As depicted in FIG. 2A to FIG. 3B, the cap 2 has a ring-shaped skirt wall 15 on which a female thread 14 threadedly engaged with the male thread 5 is formed. More specifically, the female thread 14 is formed along an inner circumferential surface of the skirt wall 15 having a cylindrical shape centered around a central axis O2 of the female thread 14. The outer periphery of a disk-shaped top wall 16 is integrally connected to an upper end portion of the skirt wall 15. The bottom surface of the top wall 16 is provided with packing 17.

The female thread 14 is formed as a quadruple thread corresponding to the male thread 5 in the illustrated example. Further, in the illustrated example, each thread of the female thread 14 includes a thread upper end portion 18 which is located at an upper end of the thread and has a height (radial dimension) and a width (vertical dimension) gradually reduced toward the upper end; a thread lower end portion 19 which is located at a lower end of the thread and has a height and width gradually reduced toward the lower end; and a thread body 20 placed between the thread upper end portion 18 and the thread lower end portion 19.

In the illustrated example, the thread body 20 has a longitudinal sectional shape (a shape cut along a plane including the central axis O2) which is consistent in the circumferential direction. Alternatively, each thread body 20 may have a longitudinal sectional shape that varies in the circumferential direction. Each thread body 20 is provided to be continuous in the circumferential direction in the illustrated example; alternatively, the thread body 20 may be provided intermittently in the circumferential direction.

Note that each thread may be constituted only by the thread body 20 without being provided with the thread upper end portion 18 or the thread lower end portion 19. Alternatively, each thread may be constituted by the thread body 20 and one of the thread upper end portion 18 and the thread lower end portion 19.

A lower end portion of the skirt wall 15 is provided with a ring-shaped tamper evident band 21. The tamper evident band 21 has a cylindrical band body 22 and a flap 23 folded at the lower end portion of the band body 22 back to the inner circumferential side and extended upward to the radially inner side. The upper end portion of the band body 22 is connected to the lower end portion of the skirt wall 15 with a breakage-expected portion 24 therebetween, the breakage-expected portion 24 being constituted by a plurality of breakable bridges spaced around the central axis O2.

In this embodiment, the flap 23 serves as a resiliently deformable portion 25 which is resiliently deformed by being pressed from above by the bead portion 6 to ride over the bead portion 6 downward. Note that the shape of the flap 23 is not limited to that in the illustrated example, and a structure other than the flap 23 may be used as the resiliently deformable portion 25.

In this embodiment, the cap 2 is assembled from two components consisting of the cap body 26 including the top wall 16, the skirt wall 15, and the tamper evident band 21 and the packing 17; alternatively, the cap 2 may be one unit in which the packing 17 is integrated with the cap body 26. Moreover, the form of the top wall 16 is not limited to that in the illustrated example. For example, an opening having a circular shape for example may be formed in the middle of the top wall 16, and the opening may be stopped by the packing 17. Note that the cap 2 can be formed for example by injection molding using a resin material.

Figure 4:
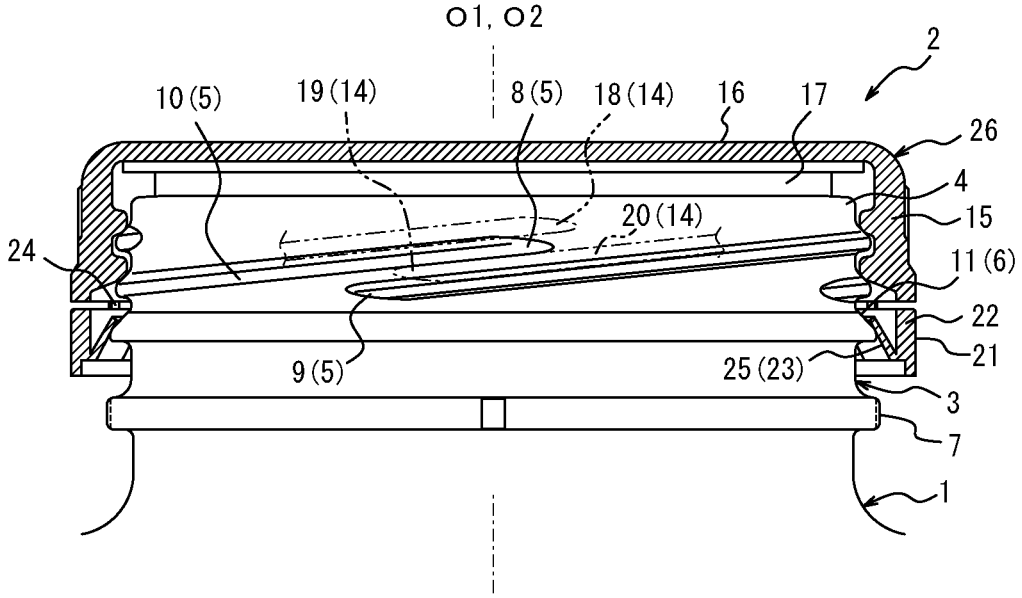
FIG. 4 is a partial cross-sectional side view illustrating a state where the cap depicted in FIGS. 2A and 2B is attached to the mouth of the container body depicted in FIGS. 1A and 1B when a resiliently deformable portion of a tamper evident band abuts a bead portion for the first time due to the screwing on of the cap.
Figure 5:
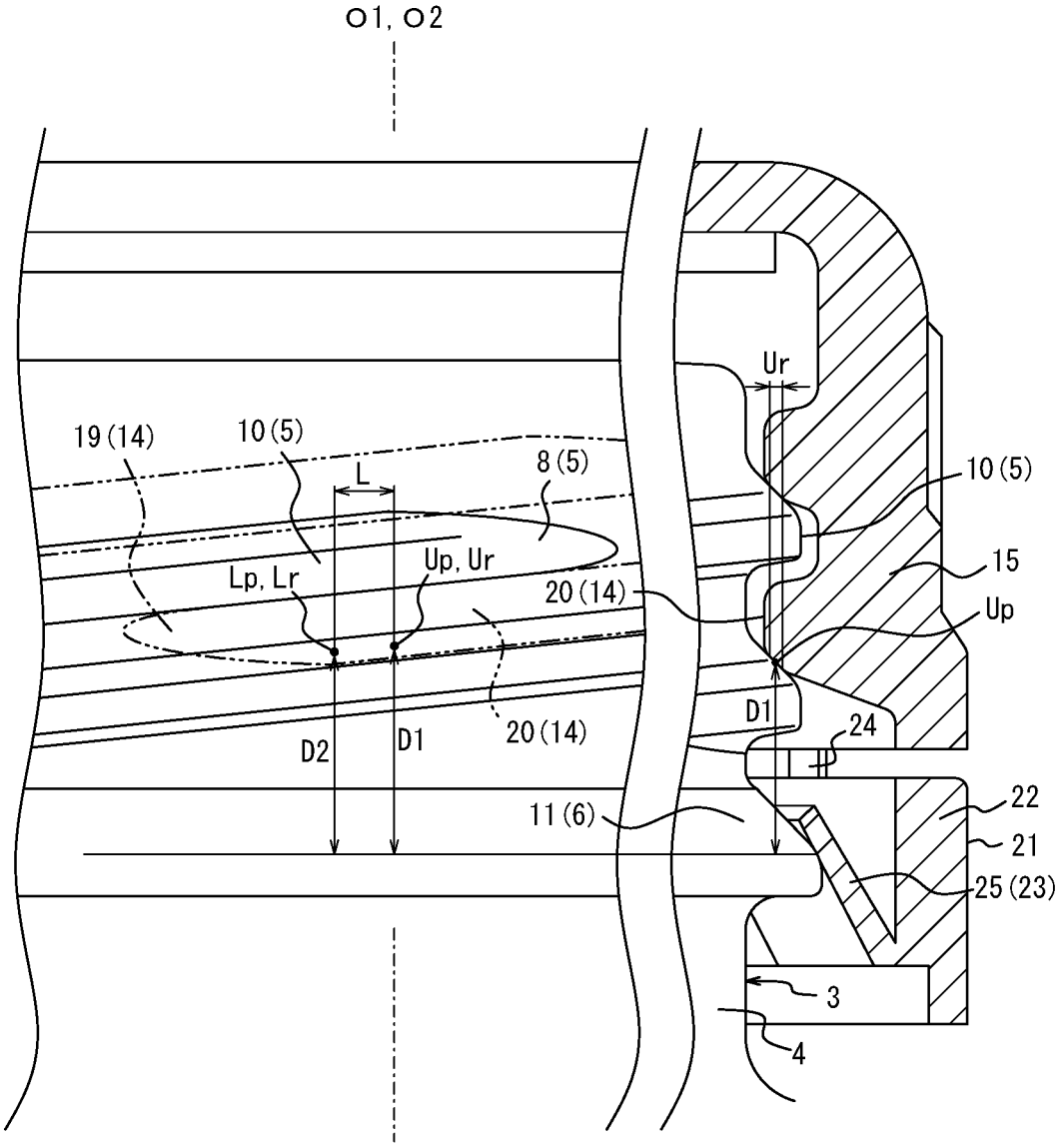
FIG. 5 is a partial enlarged view of FIG. 4.

FIGS. 4 to 5 illustrate a state where the resiliently deformable portion 25 of the tamper evident band 21 abuts the bead portion 6 for the first time due to the screwing on of the cap 2 when the cap 2 is attached to the mouth 3 using for example a capping head of a capper (not shown). As illustrated in FIG. 5 which is a partial enlarged view of FIG. 4, in this embodiment, a first distance D1 from an engagement upper end Up of the male thread 5 of the mouth 3 to the bead portion 6 is larger than a second distance D2 from an engagement lower end Lp of the female thread 14 of the cap 2 to the resiliently deformable portion 25 of the tamper evident band 21.

Here, the "engagement upper end Up of the male thread 5" means a point located at the center in the radial direction of an engagement upper end side contact area Ur as illustrated in FIG. 5. Here, the engagement upper end side contact area Ur is a part of a linear region consisting of the line of intersection between a plane including the upper end of the thread body 10 of the male thread 5 (upper end in a direction along the central axis O1) and the central axis O1, and the upper surface of another thread body 10 of the male thread 5 ("the said" thread body 10 in the case where the male thread 5 is formed as a single thread) placed directly under "the said" thread body 10, and is an area in contact with the lower surface of the thread body 20 of the female thread 14 when the cap 2 is screwed on. Further, "the first distance D1 to the bead portion 6" means a vertical distance to the portion on the upper surface 11 of the bead portion 6 on which the resiliently deformable portion 25 of the tamper evident band 21 abuts for the first time.

Figure 7:
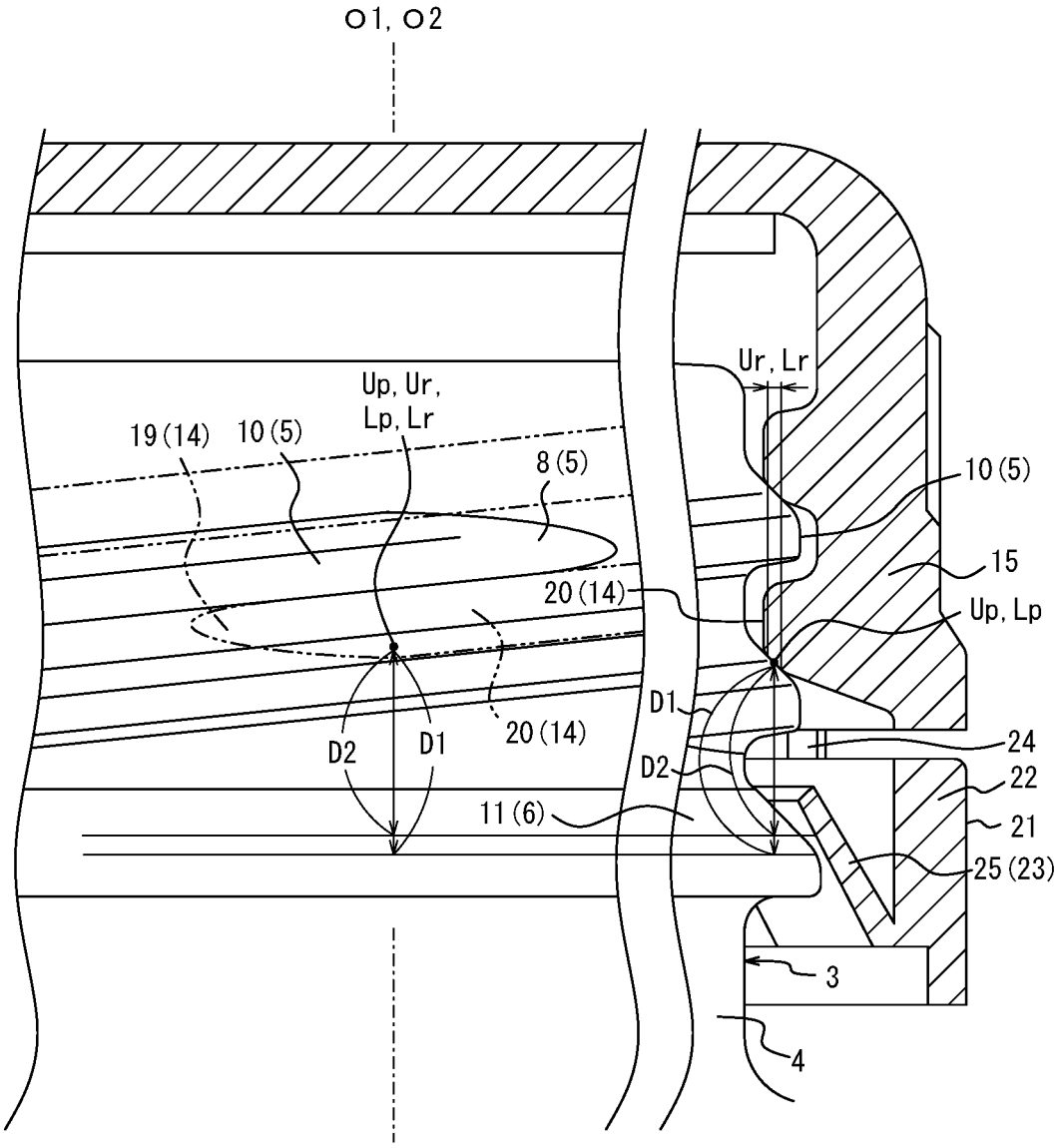
FIG. 7 is a partial enlarged view of FIG. 6.

Moreover, "the engagement lower end Lp of the female thread 14 of the cap 2" means a point located at the center in the radial direction of a engagement lower end side contact area Lr as illustrated in FIG. 7. Here, the engagement lower end side contact area Lr is a part of a linear region consisting of the line of intersection between a plane including the lower end of the thread body 20 of the female thread 14 (the lower end in a direction along the central axis O2) and the central axis O2, and the lower surface of the said thread body 20, and is an area in contact with the upper surface of the thread body 10 of the male thread 5. Further, "the second distance D2 to the resiliently deformable portion 25 of the tamper evident band 21" means a vertical distance to the portion on the lower surface of the resiliently deformable portion 25 which abuts the bead portion 6 for the first time.

Thus, in this embodiment, the first distance D1 is made larger than the second distance D2 so that the resiliently deformable portion 25 of the tamper evident band 21 abuts the bead portion 6 for the first time when the female thread 14 is engaged with the male thread 5 (that is, when the thread body 20 of the female thread 14 is engaged with the thread body 10 of the male thread 5).

Figure 6:
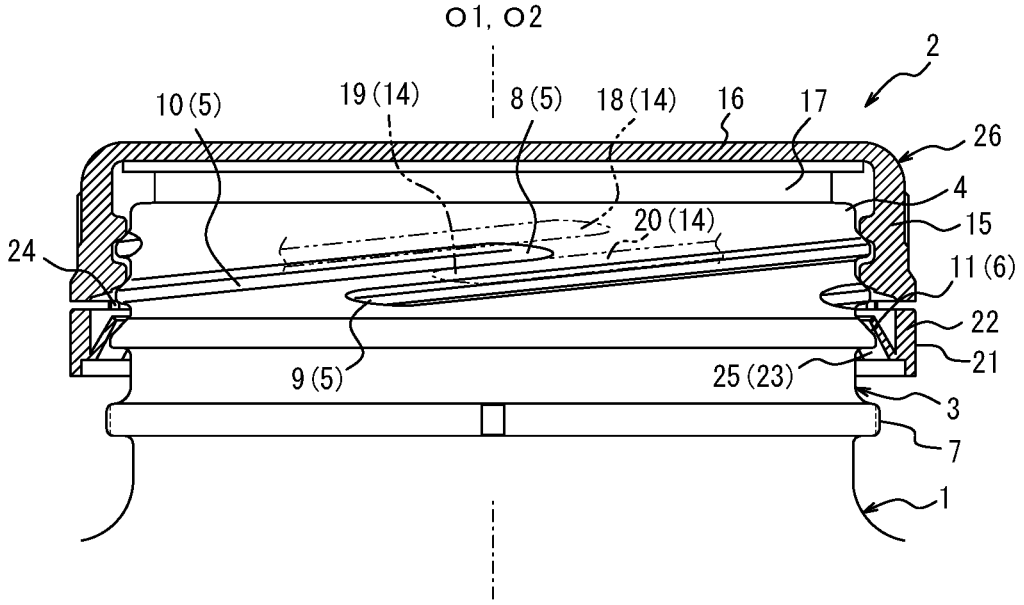
FIG. 6 is a partial cross-sectional side view illustrating a state where the cap depicted in FIGS. 2A and 2B is attached to the mouth of the container body depicted in FIGS. 1A and 1B when a female thread body of the cap and a male thread body of the container body start to be engaged.

In other words, at the point of time when the thread body 20 of the female thread 14 of the cap 2 starts to be engaged with the thread body 10 of the male thread 5 of the container body 1, the resiliently deformable portion 25 of the tamper evident band 21 does not abut the bead portion 6 as illustrated in FIG. 6 to FIG. 7.

Figure 8:
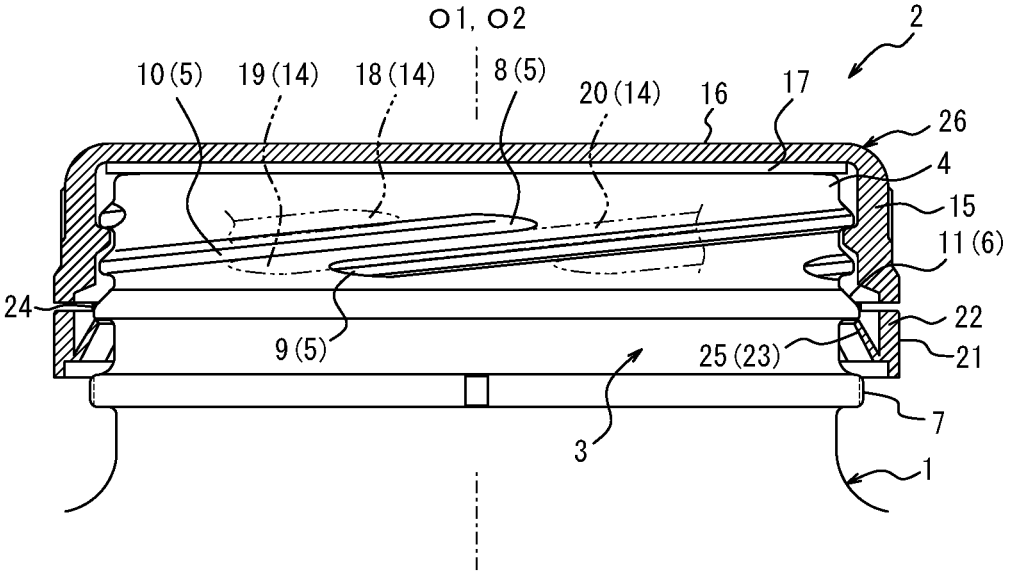
FIG. 8 is a partial cross-sectional side view illustrating a state where the cap depicted in FIGS. 2A and 2B is attached to the mouth of the container body depicted in FIGS. 1A and 1B when the attachment of the cap is completed.

Thus, according to this embodiment, the female thread 14 of the cap 2 and the male thread 5 of the container body 1 are engaged first before the resiliently deformable portion 25 of the tamper evident band 21 touches the bead portion 6, and the resiliently deformable portion 25 of the tamper evident band 21 is pressed against the bead portion 6 by the support of the thread to ride over the portion 6, thus the cap 2 can be attached as illustrated in FIG. 8.

As described above, in this embodiment, when the resiliently deformable portion 25 is pressed against the bead portion 6, the male thread 5 and the female thread 14 are engaged, so that the inclination of the cap due to the pressing of the resiliently deformable portion 25 against the bead portion 6 is suppressed, thus skewing of the cap 2 can be suppressed.

In addition, the first distance D1 and the second distance D2 are preferably set so that the resiliently deformable portion 25 of the tamper evident band 21 abuts the bead portion 6 when the female thread 14 is engaged with the male thread 5 over 5 mm or more (i.e., when the thread body 20 of the female thread 14 and the thread body 10 of the male thread 5 are engaged over 5 mm or more in the circumferential direction).

Specifically, as illustrated in FIG. 5, an engagement length L (i.e., the distance between the engagement upper end Up of the male thread 5 and the engagement lower end Lp of the female thread 14 in a direction along the circumferential direction) is preferably 5 mm or more when the resiliently deformable portion 25 abuts the bead portion 6 for the first time. When the engagement length L is 5 mm or more as described above, skewing of the cap 2 can be effectively suppressed even in the case of a wide mouth container. Further, the engagement length L is more preferably 13 mm or more, and such an engagement length L of 13 mm or more can have a more advantageous effect.

Further, in this embodiment, the inclination angle θ of the upper surface 11 of the bead portion 6 (see FIG. 1B) is preferably 30° or more. When the inclination angle θ is 30° or more as described above, the position of a portion of the upper surface 11 of the bead portion 6 on which the resiliently deformable portion 25 of the tamper evident band 21 abuts for the first time can be made lower than normal. Thus, since the first distance D1 can be made larger than normal without affecting the second distance D2, sufficient engagement latitude can be ensured when the resiliently deformable portion 25 abuts the bead portion 6 for the first time.

The above is only an embodiment of this disclosure, and various modifications can be made without departing from the scope of claims.

REFERENCE SIGNS LIST

1 Container body
2 Cap
3 Mouth
4 Mouth circumferential wall
5 Male thread
6 Bead portion
7 Neck ring
8 Thread upper end of male thread
9 Thread lower end of male thread
10 Thread body of male thread
11 Upper surface of bead portion
12 Lower surface of bead portion
13 Side surface of bead portion
14 Female thread
15 Skirt wall
16 Top wall
17 Packing
18 Thread upper end of female thread
19 Thread lower end of female thread
20 Thread body of female thread
21 Tamper evident band
22 Band body
23 Flap
24 Breakage-expected portion
25 Resiliently deformable portion
26 Cap body
O1 Central axis of male thread of mouth
O2 Central axis of female thread of cap
Up Engagement upper end of male thread Ur Engagement upper end side contact area
Lp Engagement lower end of female thread
Lr Engagement lower end side contact area
D1 First distance
D2 Second distance
L Engagement length

The invention claimed is:

1. A container including:
a container body including a tubular mouth, and
a cap attached to the mouth,
wherein:
the mouth includes:
a mouth circumferential wall having an outer circumferential surface,
a male thread, and
a ring-shaped bead portion provided around a lower portion of the male thread,
the container is a wide mouth container in which a diameter of the outer circumferential surface of the mouth circumferential wall is 60 mm or more, and the container is configured to contain a beverage or food,
the cap includes a ring-shaped skirt wall on which a female thread threadedly engaged with the male thread is formed, and a ring-shaped tamper evident band provided on a lower end portion of the skirt wall,
the tamper evident band includes a resiliently deformable portion,
a first distance from an engagement upper end of the male thread of the mouth to the bead portion is larger than a second distance from an engagement lower end of the female thread of the cap to the resiliently deformable portion of the tamper evident band such that, during the attachment of the cap to the mouth of the container body by screwing the cap onto the mouth of the container body, the female thread of the cap and the male thread of the mouth start to be threadedly engaged first, and then the resiliently deformable portion of the tamper evident band abuts the bead portion when the female thread is engaged with the male thread over an engagement length of 13 mm or more, and then the resiliently deformable portion of the tamper evident band is pressed against the bead portion by a support of further threaded engagement between the male thread and the female thread to ride over the bead portion in a direction toward the container body.

2. The container according to claim 1, wherein an inclination angle of an upper surface of the bead portion is 30° or more.

3. The container according to claim 1, wherein the deformable portion is in a form of a flap that extends in an axial direction towards a closed end of the cap and in a radially inward direction.

4. The container according to claim 1, wherein:
the engagement upper end of the male thread of the mouth is a point located at a center in a radial direction of an engagement upper end side contact area that is configured to contact a lower surface of the female thread of the cap when the cap is screwed onto the container body; and
the engagement lower end of the female thread of the cap is a point located at a center in the radial direction of an engagement lower end side contact area that is configured to contact an upper surface of the male thread of the mouth when the cap is screwed onto the container body.

5. The container according to claim 1, wherein:
the first distance from the engagement upper end of the male thread of the mouth to the bead portion is an axial distance to a portion on an upper surface of the bead portion on which the resiliently deformable portion of the tamper evident band is configured to first abut when the cap is screwed onto the container body; and
the second distance from the engagement lower end of the female thread of the cap to the resiliently deformable portion of the tamper evident band is an axial distance to a portion on a lower surface of the resiliently deformable portion which first abuts the upper surface of the bead portion when the cap is screwed onto the container body.

6. The container according to claim 1, wherein the engagement upper end of the male thread of the mouth and the engagement lower end of the female thread of the cap are configured to be positioned at a same axial position along an axis of the container when the female thread of the cap starts to be engaged with the male thread of the mouth before the resiliently deformable portion touches the bead portion.

7. The container according to claim 1, wherein the engagement length is a distance between the engagement upper end of the male thread and the engagement lower end of the female thread in a direction along a circumferential direction of the mouth.

8. A container including:
a container body including a tubular mouth, and
a cap attached to the mouth,
wherein:
the mouth includes:
a mouth circumferential wall having an outer circumferential surface,
a male thread, and
a ring-shaped bead portion provided around a lower portion of the male thread,
the container is a wide mouth container in which a diameter of the outer circumferential surface of the mouth circumferential wall is 30 mm or more, and the container is configured to contain a beverage or food,
the cap includes a ring-shaped skirt wall on which a female thread threadedly engaged with the male thread is formed, and a ring-shaped tamper evident band provided on a lower end portion of the skirt wall,
the tamper evident band includes a resiliently deformable portion,
a first distance from an engagement upper end of the male thread of the mouth to the bead portion is larger than a second distance from an engagement lower end of the female thread of the cap to the resiliently deformable portion of the tamper evident band such that, during the attachment of the cap to the mouth of the container body by screwing the cap onto the mouth of the container body, the female thread of the cap and the male thread of the mouth start to be threadedly engaged first, and then the resiliently deformable portion of the tamper evident band abuts the bead portion when the female thread is engaged with the male thread over an engagement length of 5 mm or more, and then the resiliently deformable portion of the tamper evident band is pressed against the bead portion by a support of further threaded engagement between the male thread and the female thread to ride over the bead portion in a direction toward the container body.

9. The container according to claim 8, wherein an inclination angle of an upper surface of the bead portion is 30° or more.

10. The container according to claim 8, wherein the deformable portion is in a form of a flap that extends in an axial direction towards a closed end of the cap and in a radially inward direction.

11. The container according to claim 8, wherein:

the engagement upper end of the male thread of the mouth is a point located at a center in a radial direction of an engagement upper end side contact area that is configured to contact a lower surface of the female thread of the cap when the cap is screwed onto the container body; and the engagement lower end of the female thread of the cap is a point located at a center in the radial direction of an engagement lower end side contact area that is configured to contact an upper surface of the male thread of the mouth when the cap is screwed onto the container body.

12. The container according to claim 8, wherein:

the first distance from the engagement upper end of the male thread of the mouth to the bead portion is an axial distance to a portion on an upper surface of the bead portion on which the resiliently deformable portion of the tamper evident band is configured to first abut when the cap is screwed onto the container body; and the second distance from the engagement lower end of the female thread of the cap to the resiliently deformable portion of the tamper evident band is an axial distance to a portion on a lower surface of the resiliently deformable portion which first abuts the upper surface of the bead portion when the cap is screwed onto the container body.

13. The container according to claim 8, wherein the engagement upper end of the male thread of the mouth and the engagement lower end of the female thread of the cap are configured to be positioned at a same axial position along an axis of the container when the female thread of the cap starts to be engaged with the male thread of the mouth before the resiliently deformable portion touches the bead portion.

14. The container according to claim 8, wherein the engagement length is a distance between the engagement upper end of the male thread and the engagement lower end of the female thread in a direction along a circumferential direction of the mouth.

15. The container according to claim 8, wherein the first distance and the second distance are set so that, during the attachment of the cap to the mouth of the container body by screwing the cap onto the mouth of the container body, the female thread of the cap and the male thread of the mouth start to be threadedly engaged first, and then the resiliently deformable portion of the tamper evident band abuts the bead portion when the female thread is engaged with the male thread over an engagement length of 13 mm or more, and then the resiliently deformable portion of the tamper evident band is pressed against the bead portion by a support of further threaded engagement between the male thread and the female thread to ride over the bead portion in the direction toward the container body.

* * * * *